US005466171A

United States Patent [19]

Bixler et al.

[11] Patent Number: 5,466,171

[45] Date of Patent: Nov. 14, 1995

[54] POLARIZING SYSTEM FOR A BLIND MATING ELECTRICAL CONNECTOR ASSEMBLY

[75] Inventors: Graig Bixler, Elmhurst; Richard A. Nelson, Glen Ellyn, both of Ill.

[73] Assignee: Molex Incorporated, Lisle, Ill.

[21] Appl. No.: 308,225

[22] Filed: Sep. 19, 1994

[51] Int. Cl.[6] ..... H01R 13/629; H01R 13/64

[52] U.S. Cl. ..... 439/378; 439/680

[58] Field of Search ..... 439/378, 680, 439/681, 679, 246–248

[56] References Cited

U.S. PATENT DOCUMENTS

| | | | |
|---|---|---|---|
| 3,112,974 | 12/1963 | Curtis et al. | 439/680 |
| 4,761,144 | 8/1988 | Hunt, III et al. | 439/545 |
| 4,820,180 | 4/1989 | Mosquera et al. | 439/248 |
| 4,915,641 | 4/1990 | Miskin et al. | 439/247 |
| 5,080,604 | 1/1992 | Rider et al. | 439/357 |
| 5,173,063 | 12/1992 | Barkus et al. | 439/681 |
| 5,199,884 | 4/1993 | Kaufman et al. | 439/74 |
| 5,211,585 | 5/1993 | Douty et al. | 439/680 |
| 5,302,134 | 4/1994 | Thomas et al. | 439/247 |

*Primary Examiner*—Gary F. Paumen
*Attorney, Agent, or Firm*—Charles S. Cohen

[57] ABSTRACT

A polarizing system is incorporated in a blind mating electrical connector assembly which includes first and second electrical connectors respectively having first and second dielectric housings mateable along a separable mating interface. The housings are elongated and define respective longitudinal axes located generally centrally of the mating interface in a lateral direction. A pair of polarizing posts are spaced longitudinally of the first connector and project therefrom at the mating interface. The posts are centered generally on the longitudinal axis of the first housing, and one of the posts is wider than the other post in the lateral direction. A pair of polarizing receptacles are spaced longitudinally of the second connector for receiving the polarizing posts of the first connector. The receptacles are centered generally on the longitudinal axis of the second housing, and one of the receptacles is wider than the other receptacle for receiving the one post. The tips of the posts and the mouths of the receptacles are bevelled to facilitate blind mating of the connectors.

11 Claims, 4 Drawing Sheets

POLARIZING SYSTEM FOR A BLIND MATING ELECTRICAL CONNECTOR ASSEMBLY

FIELD OF THE INVENTION

This invention generally relates to the art of electrical connectors and, particularly, to a system for polarizing a pair of blind mateable electrical connectors.

BACKGROUND OF THE INVENTION

Generally, many electrical connectors include opposed mateable male and female electrical connector halves, each of which includes a nonconductive or dielectric housing and at least one electrical terminal securely mounted therein. Electrical conductors or lead wires may be joined to the terminals mounted in the housings. On the other hand, the dielectric housing of at least one half of the electrical connector assembly may be mounted to a printed circuit board.

When electrically connecting two connectors, some lead-in is always provided to accommodate minor misalignment between the connectors. In some instances, particularly when interconnecting two parallel printed circuit boards by means of a pair of connectors, a person may not be able to see the connectors very well or the accuracy of a mechanical alignment mechanism separate from the connectors (such as a rack and panel arrangement) may be insufficient. Such situations are often referred to as blind mate arrangements and require a structure to overcome significant misalignment. Accordingly, it is sometimes desirable to include a course alignment or blind mate feature in order to simplify mating of the printed circuit boards. In addition, it is desirable to polarize mating connectors to prevent the connectors from being mated in an incorrect orientation. Some prior art connector assemblies have blind mate projections on one connector and complementary receptacles or apertures in the other connector that are offset from the longitudinal centerlines of the connectors in order to provide polarization. An example of such a system is shown in U.S. Pat. No. 5,199,884 to Kaufman et al., dated Aug. 6, 1993. One of the problems with those types of polarization systems is that, as the connectors become smaller or miniaturized, it becomes more and more difficult for a user to see the initial correct orientation because the amount of offset from the centerlines of the connectors will decrease due to minimum wall thickness requirements of the dielectric housings of the connectors. The present invention is directed to providing a polarization system in a blind mateable electrical connector assembly which solves these and other problems of the prior art.

SUMMARY OF THE INVENTION

An object, therefore, of the invention is to provide a new and improved polarizing system for a blind mating electrical connector assembly.

In the exemplary embodiment of the invention, the connector assembly includes first and second electrical connectors respectively having first and second dielectric housings mateable along a separable mating interface. The housings are elongated and define respective longitudinal axes located generally centrally of the mating interface in a lateral direction. A pair of polarizing posts are spaced longitudinally of the first connector generally at opposite ends thereof. The posts project from the first housing at the mating interface, and the posts are centered generally on the longitudinal axis of the first housing. One of the posts is wider than the other post in the lateral direction.

A pair of polarizing receptacles are spaced longitudinally of the second connector for receiving the polarizing posts of the first connector. Again, the receptacles are centered generally on the longitudinal axis of the second housing, and one of the receptacles is wider than the other receptacle for receiving the one post. At least one of the tips of the posts and the mouths of the receptacles is bevelled to facilitate blind mating of the connectors.

The first connector is adapted for mounting on a printed circuit board and includes a pair of board-mounting posts projecting from the first housing. The board-mounting posts are generally aligned with the polarizing posts and project in a direction opposite therefrom. Similarly, the second connector is adapted for mounting on a printed circuit board and includes a pair of board-mounting posts projecting from the second housing. The board-mounting posts on the second connector are generally aligned with the polarizing receptacles in the lateral direction.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
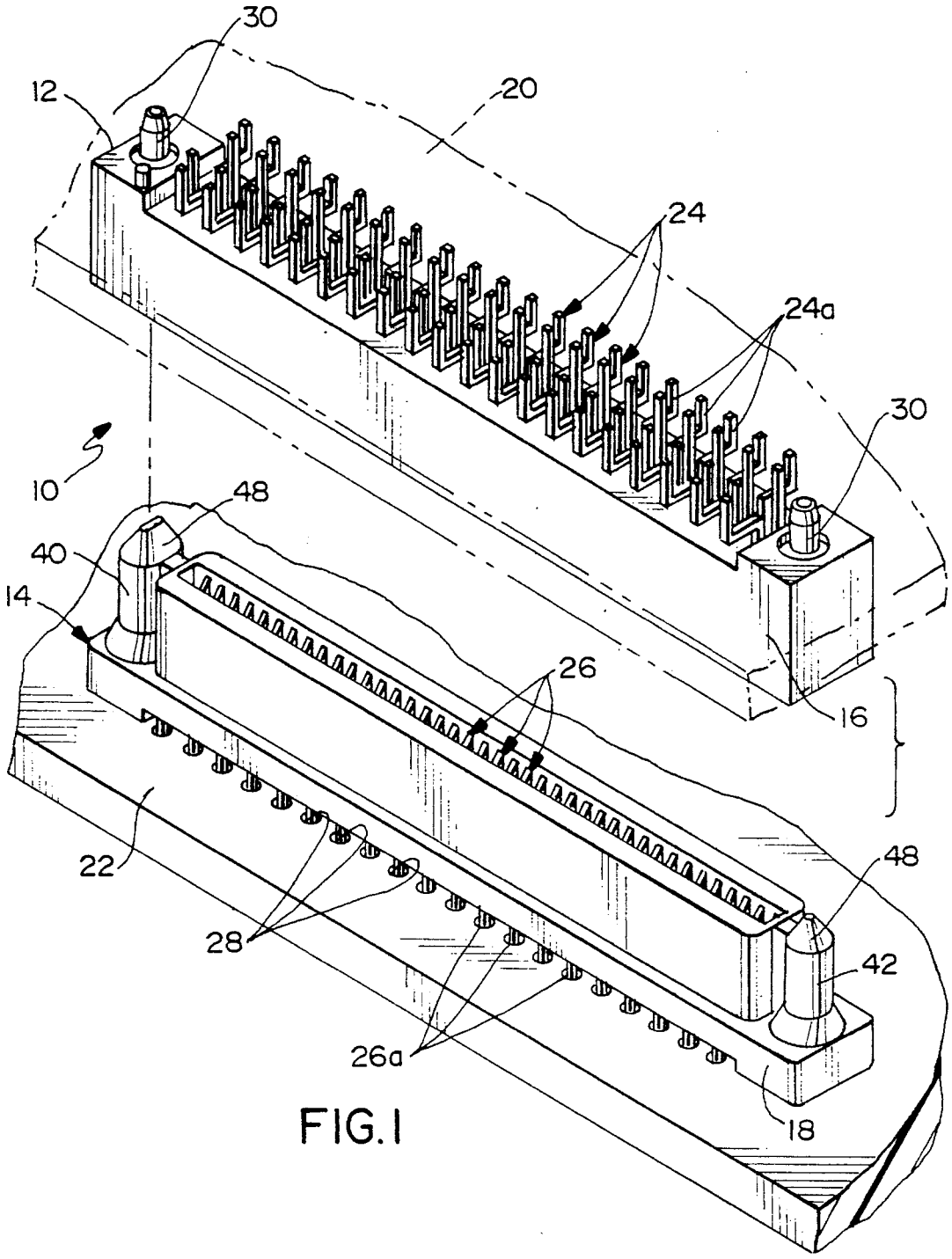
FIG. 1 is a perspective view of an electrical connector assembly, including a pair of mating connectors, incorporating the concepts of the invention, and with the connectors in unmated condition.
Figure 2:
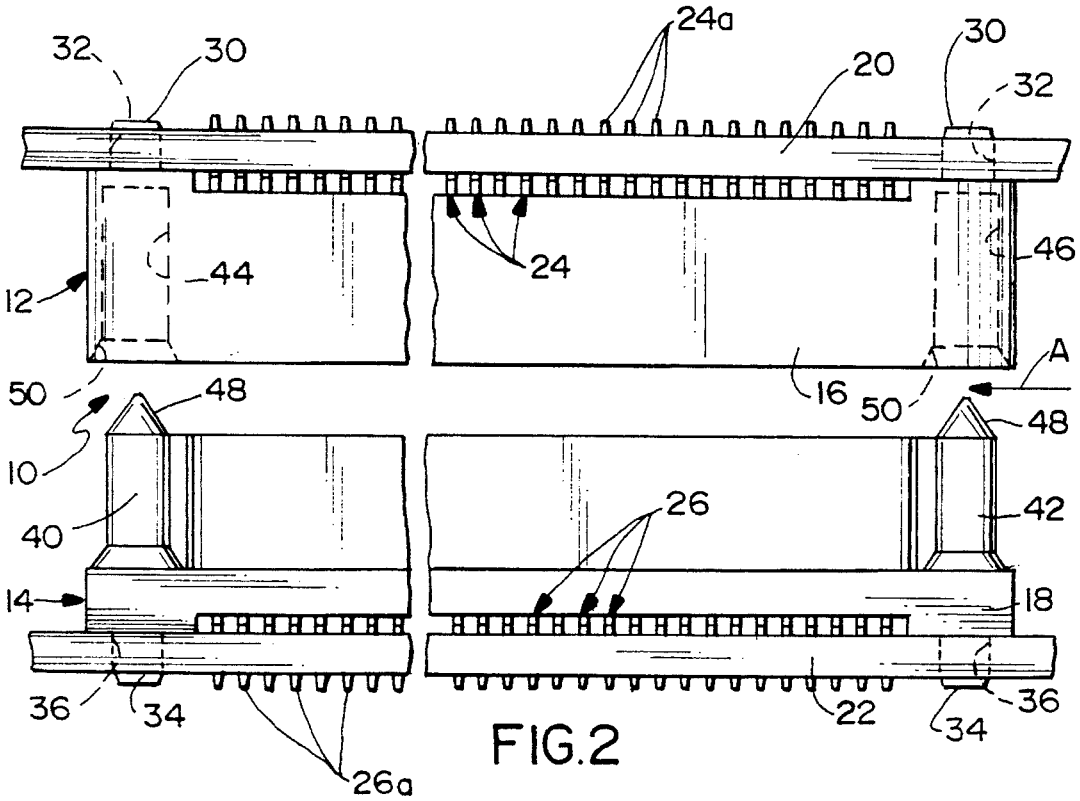
FIG. 2 is a fragmented elevational view of the connectors in unmated condition.

Referring to the drawings in greater detail, and first to FIGS. 1 and 2, the polarizing system of the invention is incorporated in a blind mating electrical connector assembly, generally designated 10, which includes first and second electrical connectors, generally designated 12 and 14, respectively. The first and second connectors have first and second dielectric housings 16 and 18, respectively, that are mateable along a separable mating interface indicated by arrow "A" in FIG. 2. It can be seen that the connectors and their housings are generally elongated.

Connectors 12 and 14 are adapted for mounting to a pair of printed circuit boards 20 and 22, respectively. Connector 12 has a plurality of terminals, generally designated 24, mounted within dielectric housing 16 and including tail portions 24a for insertion into appropriate mounting holes in printed circuit board 20. Connector 14 has a plurality of terminals, generally designated 26, mounted in dielectric housing 18 and including tail portions 26*a* for positioning in holes 28 in printed circuit board 22. Connector 12 has a pair of board-mounting posts 30 for insertion into mounting holes 32 (FIG. 2) in printed circuit board 20, and connector 14 has a pair of board-mounting posts 34 (FIG. 2) for insertion into mounting holes 36 in printed circuit board 22.

The blind mating and polarizing system of the invention is incorporated in a pair of polarizing posts 40 and 42 that project from connector 14 for insertion into a pair of polarizing receptacles 44 and 46, respectively, in connector 12. The connectors are shown properly aligned in FIG. 2 with the posts and receptacles correspondingly aligned. However, the top of the posts are significantly tapered, as at 48, and the receptacles have tapered or beveled mouths 50 (FIG. 2) to facilitate blind mating of the connectors as will be described in more detail hereinafter.

Figure 3:
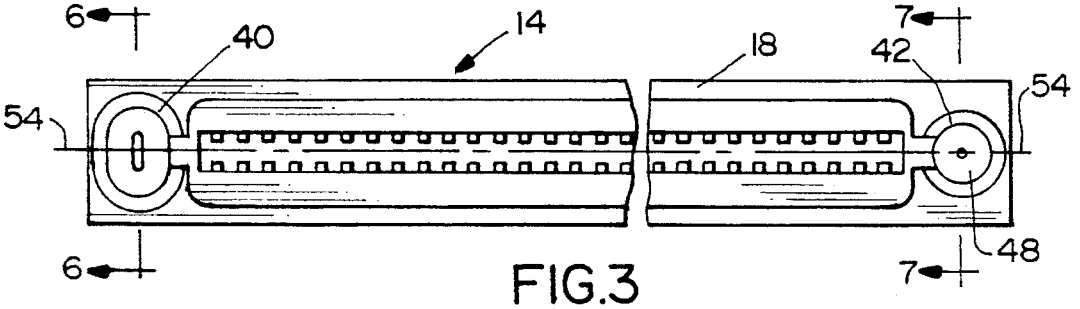
FIG. 3 is a fragmented plan view of the mating face of the bottom connector shown in FIGS. 1 and 2.
Figure 4:
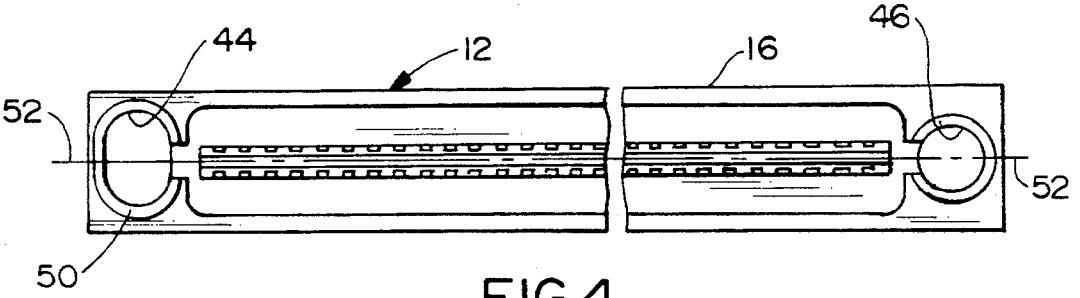
FIG. 4 is a fragmented plan view of the mating face of the top connector shown in FIGS. 1 and 2.

Referring to FIGS. 3 and 4 in conjunction with FIGS. 1 and 2, the elongated housings 16 and 18 of connectors 12 and 14, respectively, define longitudinal axes 52 and 54, respectively, that are located generally centrally of the mating interface of the connectors in a lateral direction. In other words, the centerlines are located generally equidistant from the sides of the respective connector housings. The invention contemplates that polarizing posts 40 and 42 of connector 14 be centered on centerline 54, and that polarizing receptacles 44 and 46 be located on centerline 52 of connector 12.

Figure 6:
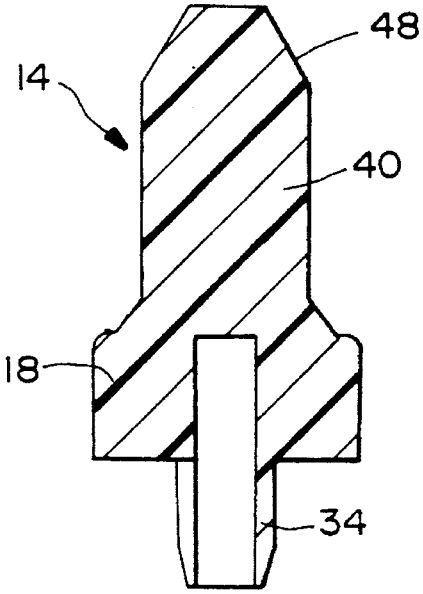
FIG. 6 is a section taken generally along line 6—6 of FIG. 3.
Figure 7:
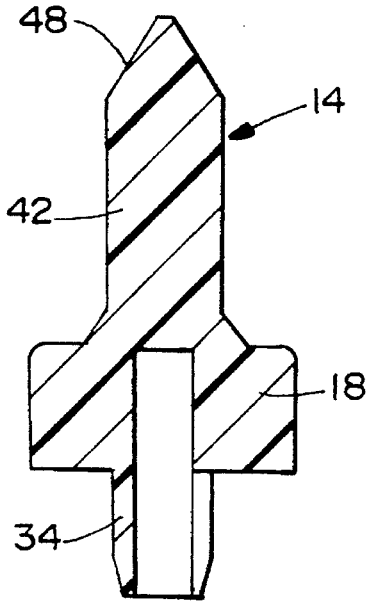
FIG. 7 is a section taken generally along line 7—7 of FIG. 3.

Still referring to FIGS. 3 and 4 in conjunction with FIGS. 1 and 2 (and particularly FIG. 1), it can be seen that polarizing post 40 on connector 14 and its respective polarizing receptacle 44 in connector 12 are significantly wider than polarizing post 42 and its receptacle 46. The exaggerated width of post 40 and receptacle 44 are in the lateral direction (i.e. perpendicular to axes 52 and 54). By making one set of posts and receptacles wider than the other set thereof, a convenient polarizing system is afforded thereby. However, in addition, by locating the posts and receptacles on the centerlines of the respective connector housings, a user can easily observe the correct initial orientation of the connectors regardless of the size or miniaturization of the connectors. In other words, by increasing the lateral width of post 40 and receptacle 44, rather than offsetting one or both posts and their respective receptacles as is prevalent in the prior art, the size differential between the posts can be doubled without decreasing the housing wall thickness. Referring to FIGS. 1, 6 and 7, it can be seen that the top 48 of post 42 is generally conical or frusto-conical, and the top 48 of post 42 is identical except elongated in the lateral direction. Thus, the top of post 42 is generally conical or frusto-conical in the longitudinal direction of the housing 18 and has a generally trapezoidal cross-section in the lateral direction.

Figure 5:
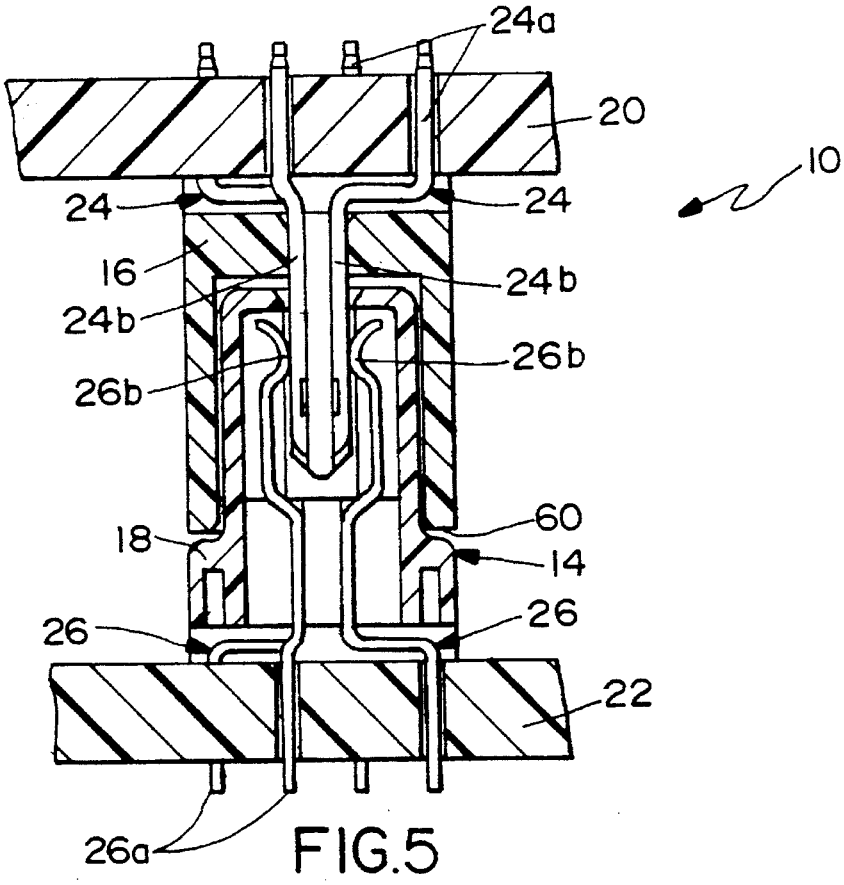
FIG. 5 is a vertical section through the connector assembly, with the connectors fully mated.

FIG. 5 shows connectors 12 and 14 of connector assembly 10 in fully mated condition. The mated connectors define a separable mating interface 60. Terminals 24 of connector 12 have contact portions 24b for engaging or mating with contact portions 26b of terminals 26 of connector 14.

FIGS. 6 and 7 show sections through polarizing posts 40 and 42, respectively, to better illustrate that board-mounting posts 34 are aligned with the polarizing posts in the lateral direction of the connectors. This feature allows for efficient use of the "real estate" of the connector and is particularly advantageous with miniaturized connectors. For this same reason, and referring back to FIG. 2, board-mounting posts 30 of connector 12 are aligned with receptacles 44 and 46 in the lateral direction of connector 12.

Figure 8:
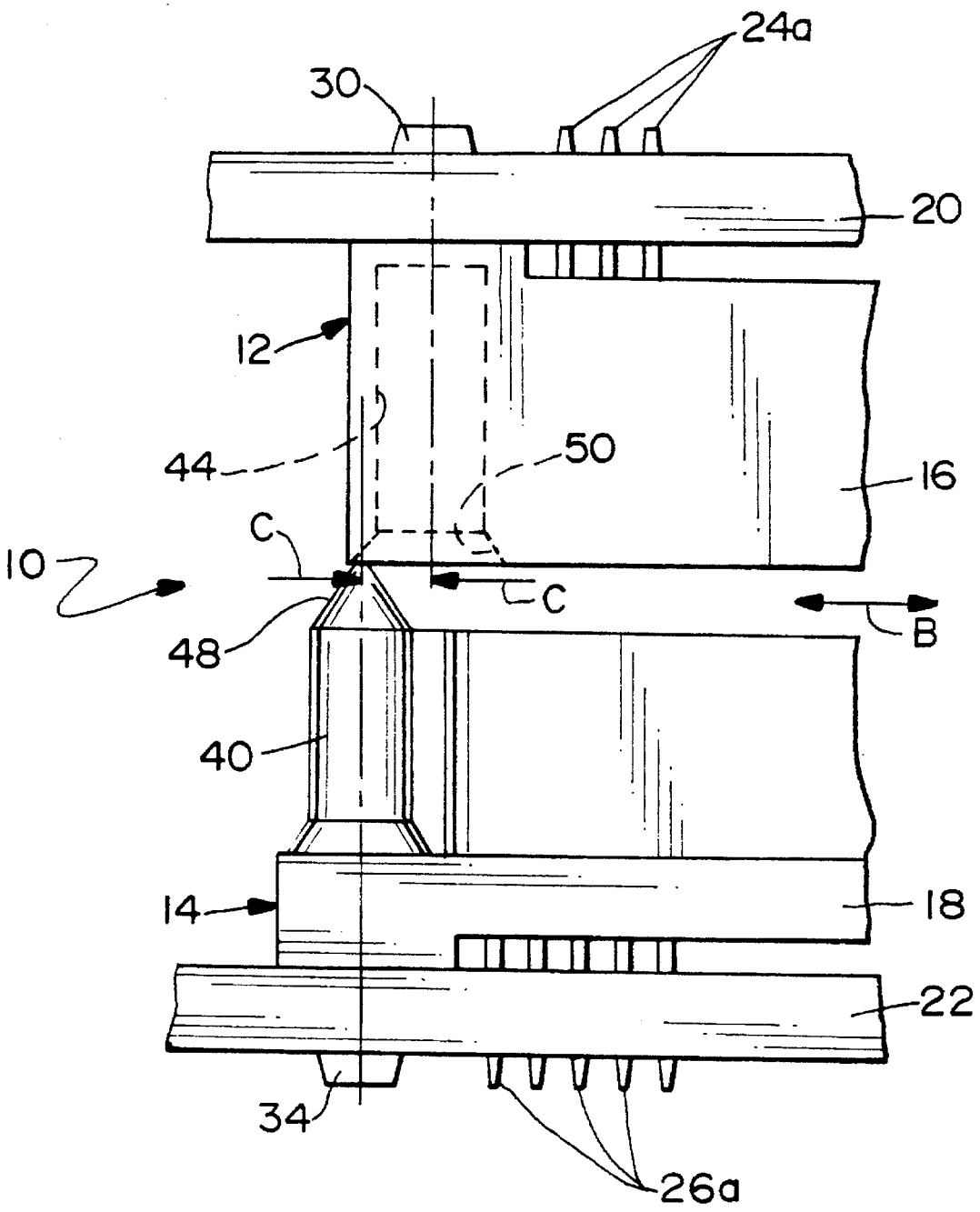
FIG. 8 is an elevational view of the left-hand end of FIG. 2, showing the connectors about to be mated and in a misaligned condition.

Lastly, FIG. 8 shows connectors 12 and 14 about to be mated, but the connectors are offset laterally in the direction of double-headed arrow "B". The total offset as shown is indicated by arrows "C" which are on the centers of polarizing post 40 and polarizing receptacle 44. This offset, in fact, is more than one-half the dimension of the post in the longitudinal direction. Yet, the connectors will be mated due to the tapered tip 48 of the post and the tapered mouth 50 of the receptacle. Thus, blind mating is facilitated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A polarizing system for a blind mating electrical connector assembly which includes first and second electrical connectors respectively having first and second dielectric housings mateable along a separable mating interface, with each housing being elongated and including a pair of generally parallel sides with a longitudinal axis generally midway between said sides, comprising:

a pair of polarizing posts spaced longitudinally of the first connector generally at opposite ends thereof and projecting from the first housing and being integrally formed therewith at the mating interface, the posts being centered generally on the longitudinal axis of the first housing, and one of the posts being wider than the other post in a direction normal to said longitudinal axis;

a pair of polarizing receptacles spaced longitudinally of the second connector for receiving the polarizing posts of the first connector, the receptacles being centered generally on the longitudinal axis of the second housing and being integrally formed therewith, and one of the receptacles being wider than the the receptacle in a direction normal to said longitudinal axis for receiving said one post, each receptacle being dimensioned to substantially surround its receptacle polarizing post upon mating of said first and second electrical connectors; and at least one of the tips of the posts and the mouths of the receptacles being bevelled to facilitate blind mating of the connectors.

2. The polarizing system of claim 1 wherein both the tips of the posts and the mouths of the receptacles are bevelled.

3. The polarizing system of claim 1 wherein said first connector is adapted for mounting on a printed circuit board and includes a pair of board-mounting posts projecting from the first housing, the board-mounting posts being generally aligned with the polarizing posts and projecting in a direction opposite therefrom.

4. The polarizing system of claim 1 wherein said second connector is adapted for mounting on a printed circuit board and includes a pair of board-mounting posts projecting from the second housing, the board-mounting posts being generally aligned with the polarizing receptacles.

5. The polarizing system of claim 4 wherein said first connector is adapted for mounting on a printed circuit board and includes a pair of board-mounting posts projecting from the first housing, the board-mounting posts being generally aligned with the polarizing posts and projecting in a direction opposite therefrom.

6. The polarizing system of claim 1 wherein the end of said one post includes a generally trapezoidal cross-section in a direction generally perpendicular to said longitudinal axis of said first connector.

7. A polarizing system for electrical connector assembly which includes first and second electrical connectors respectively having first and second dielectric housings mateable along a separable mating interface, with each housing being elongated and including a pair of generally parallel sides with a longitudinal axis generally midway between said sides, comprising:

a pair of polarizing posts spaced longitudinally of the first connector and projecting from the first housing and being integrally formed therewith at the mating interface, the posts being centered generally on the longitudinal axis of the first housing, and one of the posts being wider than the other post; and a pair of polarizing receptacles spaced longitudinally of the second connector for receiving the polarizing posts of the first connector, the receptacles being centered generally on the longitudinal axis of the second housing and being integrally formed therewith, and one of the receptacles being wider than the other receptacle in a direction normal to said longitudinal axis for receiving said one post, each receptacle being dimensioned to substantially surround its respective polarizing post upon mating of said first and second electrical connectors.

8. The polarizing system of claim 7 wherein said first connector is adapted for mounting on a printed circuit board and includes a pair of board-mounting posts projecting from the first housing, the board-mounting posts being generally aligned with the polarizing posts and projecting in a direction opposite therefrom.

9. The polarizing system of claim 7 wherein said second connector is adapted for mounting on a printed circuit board and includes a pair of board-mounting posts projecting from the second housing, the board-mounting posts being generally aligned with the polarizing receptacles.

10. The polarizing system of claim 9 wherein said first connector is adapted for mounting on a printed circuit board and includes a pair of board-mounting posts projecting from the first housing, the board-mounting posts being generally aligned with the polarizing posts and projecting in a direction opposite therefrom.

11. The polarizing system of claim 7 wherein the end of said one post includes a generally trapezoidal cross-section in a direction generally perpendicular to said longitudinal axis of said first connector.

* * * * *